US006837741B2

(12) United States Patent
Kuwahara

(10) Patent No.: US 6,837,741 B2
(45) Date of Patent: Jan. 4, 2005

(54) CONNECTOR AND CABLE POSITIONING MEMBER OF CONNECTOR

(75) Inventor: Koichi Kuwahara, Chiba (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 10/800,669

(22) Filed: Mar. 16, 2004

(65) Prior Publication Data

US 2004/0185708 A1 Sep. 23, 2004

(30) Foreign Application Priority Data

Mar. 17, 2003 (JP) ..... P2003-072735

(51) Int. Cl.[7] ..... H01R 12/24
(52) U.S. Cl. ..... 439/497; 439/579
(58) Field of Search ..... 439/497, 579, 439/942, 610, 98

(56) References Cited

U.S. PATENT DOCUMENTS 5,281,762 A * 1/1994 Long et al. ..... 439/579
5,964,620 A * 10/1999 Takahashi et al. ..... 439/579
5,997,348 A * 12/1999 Shepherd ..... 439/579
6,380,485 B1 * 4/2002 Beaman et al. ..... 439/579
6,489,563 B1 * 12/2002 Zhao et al. ..... 439/497

FOREIGN PATENT DOCUMENTS

JP 11-297133 A 10/1999
JP 2000-277226 A 10/2000

* cited by examiner

*Primary Examiner*—Tho D. Ta
(74) *Attorney, Agent, or Firm*—Sughrue Mion, PLLC

(57) ABSTRACT

A connector having a connector main body including a base and a plurality of signal terminals and a plurality of ground terminals both fixed to the base; and a cable positioning member made of conductors for positioning a plurality of cables relative to the connector main body, the cable positioning member including a plurality of securing portions at which the cable positioning member is secured to the ground terminals, and a cable holding portion including a plurality of outer conductor holding portions adapted to hold an outer conductor protruding from the end of each cable and a plurality of insulating layer holding portions adapted to hold an insulating layer protruding from the end of each cable. The cable positioning member is electrically contacted to the ground terminals at the securing portions and to the outer conductors at the outer conductor holding portions.

19 Claims, 7 Drawing Sheets

CONNECTOR AND CABLE POSITIONING MEMBER OF CONNECTOR

CROSS-REFERENCE TO RELATED APPLICATIONS

This application is based upon and claims the benefit of priority from Japanese Patent Application No. 2003-72735 filed on Mar. 17, 2003, the entire contents of which are incorporated by reference herein.

BACKGROUND OF THE INVENTION

1. Field of the Invention

This invention relates to a connector and a cable positioning member of the connector. More specifically, this invention relates to a cable positioning member of a connector used when connecting a cable to the main body of a connector, that enables improved electric properties of the connector through regulating and making uniform the pitch between cables in a plurality of cables as well as a connector that utilizes this cable positioning member.

2. Description of Related Art

FIG. 1 shows a method of connecting outer conductors of coaxial cables to each other using a ground bar. In such structure in which a plurality of outer conductors are collectively connected (also known as a bundle shield structure), it is difficult to maintain a uniform pitch of coaxial cables, especially, central conductors and outer conductors of the coaxial cables. Thus, a plurality of coaxial cables arranged at a uniform pitch are first secured using tape or the like and the outer conductors of the coaxial cables are connected together as one batch by ground bars 101 and 103 for connection to a main body of a connector.

As shown in FIG. 2, a printed circuit board 109 called a paddle card is secured to a connecting portion 107 of a main body 105 of a connector. A signal line is connected to a contacting part 111 of the printed circuit board 109. Such structures and connecting methods have been disclosed in Japanese Unexamined Patent Publication No. Hei 11-297133 and Japanese Unexamined Patent Publication No. 2000-277226.

As described, the related art method of connecting outer conductors using a ground bar involves first securing a plurality of coaxial cables arranged at a uniform pitch using tape or the like, and connecting the outer conductors of those coaxial cables together as one batch using a ground bar for connection to the main body of a connector. Problems incurred by this conventional technology are the expenses required for the materials used and the processes required for production.

Further, generally, when the outer conductors are connected together the ground bar is secured in position by soldering, however when the molten solder hardens the outer conductors are pulled as the solder contracts, affecting the pitch of the coaxial cables and causing changes in the dimensions and positional relationships of the central conductors, the insulating layers and the outer conductors cross-sectionally with respect to the soldered parts. This creates problems due to changes arising in impedance and adversely affects signal transmission.

Moreover, this printed circuit board 109 (a multilayered structure printed circuit board for example) is a part of and thereby affects the very structure of the connector itself inhibiting improvements being made to the characteristics of the connector. Further, the considerable number of parts involved increases the cost of such a connector.

SUMMARY OF THE INVENTION

With the foregoing problems affecting the related art technology in view, it is an object of the present invention to solve these problems by providing a cable positioning member of a connector that enables improved electrical characteristics through regulating and making uniform the pitch between cables in an array of cables.

It is a further object of the present invention to provide a connector that utilizes this cable positioning member.

In order to achieve these objectives, according to a first aspect of the present invention a connector is provided that comprises: a connector main body including a base and a plurality of signal terminals and a plurality of ground terminals both fixed to the base; and a cable positioning member made of conductors for positioning a plurality of cables relative to the connector main body, the cable positioning member including a plurality of securing portions at which the cable positioning member is secured to the ground terminals, and a cable holding portion including a plurality of outer conductor holding portions adapted to hold an outer conductor protruding from the end of each cable and a plurality of insulating layer holding portions adapted to hold an insulating layer protruding from the end of each cable, wherein the cable positioning member is electrically contacted to the ground terminals at the securing portions and to the outer conductors at the outer conductor holding portions.

According to another aspect of the present invention a connector is provided wherein each of the securing portions includes a recess that engages each of the ground terminal that protrudes from the base toward the cable positioning member.

According to yet another aspect of the present invention a connector is provided wherein each of the insulating layer holding portions is a through-hole, and each of the outer conductor holding portions is a recess that has one end of the through-hole on a bottom surface of the recess.

According to yet another aspect of the present invention a connector is provided wherein the securing portions and the ground terminals are secured to each other and electrically connected by engagement and soldering.

According to yet another aspect of the present invention a connector is provided wherein when the outer conductor holding portions hold outer conductors of a plurality of cables, the plurality of outer conductors are connected as one batch enabling conduction between the outer conductors.

According to yet another aspect of the present invention a connector is provided wherein when the outer conductor holding portions hold outer conductors of a plurality of cables, and when the insulating layer holding portions hold insulating layers of the plurality of cables, the outer conductors, insulating layers and center conductors of the cables are positioned in the predetermined position in relation to the connector main body.

According to yet another aspect of the present invention a connector is provided wherein when the outer conductor holding portions hold outer conductors of a plurality of cables, and when the insulating layer holding portions hold insulating layers of the cables, a center conductor of each of the cables is connected to each of the signal terminals of the connector main body.

According to yet another aspect of the present invention a cable positioning member is provided that is made of conductors for positioning a plurality of cables relative to a connector main body that includes a base and a plurality of signal terminals and a plurality of ground terminals both fixed to the base, the cable positioning member comprises: a plurality of securing portions at which the cable positioning member is adopted to be secured to the ground terminals; and a cable holding portion including a plurality of outer conductor holding portions adapted to hold an outer conductor protruding from the end of each cable and a plurality of insulating layer holding portions adapted to hold an insulating layer protruding from the end of each cable, wherein the cable positioning member is adapted to be electrically contacted to the ground terminals at the securing portions and to the outer conductors at the outer conductor holding portions.

According to yet another aspect of the present invention an assembled cable is provided that comprises: a plurality of cables each of which includes a central conductor, an insulating layer covering the central conductor and an outer conductor covering the insulating layer; and a connector attached to the plurality of cables, the connector including a connector main body having a base and a plurality of signal terminals and a plurality of ground terminals both fixed to the base, and a cable positioning member made of conductors for positioning the plurality of cables relative to the connector main body, the cable positioning member including a plurality of securing portions at which the cable positioning member is secured to the ground terminals, and a cable holding portion including a plurality of outer conductor holding portions for holding an outer conductor protruding from the end of each cable and a plurality of insulating layer holding portions for holding an insulating layer protruding from the end of each cable, wherein the cable positioning member is electrically contacted to the ground terminals at the securing portions and to the outer conductors at the outer conductor holding portions.

According to yet another aspect of the present invention an assembled cable is provided wherein the cables include a coaxial cable.

According to yet another aspect of the present invention a n assembled cable is provided wherein the cables include a twin coaxial cable.

BRIEF DESCRIPTION OF THE ACCOMPANYING DRAWINGS

These and other objects, features and advantages will become clearer from the following description of exemplary embodiments of the invention, read in connection with the accompanying drawings in which.

DETAILED DESCRIPTION OF THE INVENTION

Figure 1:
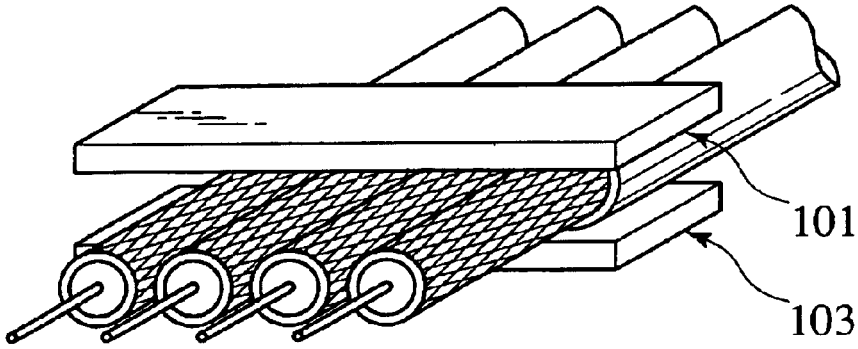
FIG.1 PRIOR ART
FIGS. 1 and 2 show related art technology.
Figure 2:
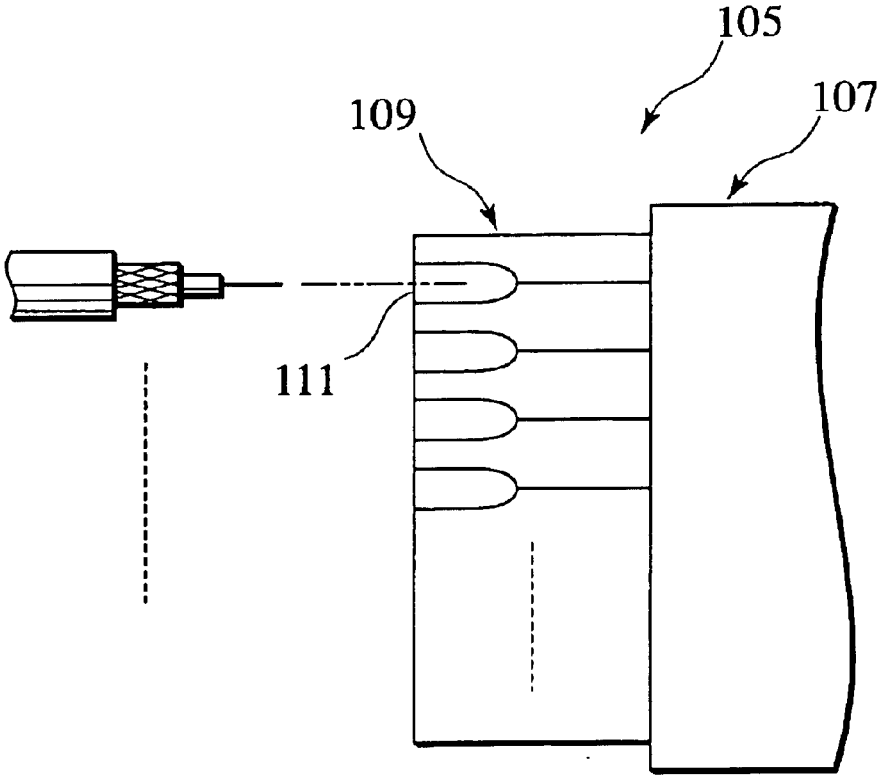
FIG.2 PRIOR ART

Exemplary embodiments of the invention will now be described below with reference to the accompanying drawings. The described exemplary embodiments are intended to assist the understanding of the invention, and are not intended to limit the scope of the invention in any way. In these drawings, like reference numerals identify like elements.

Figure 3:
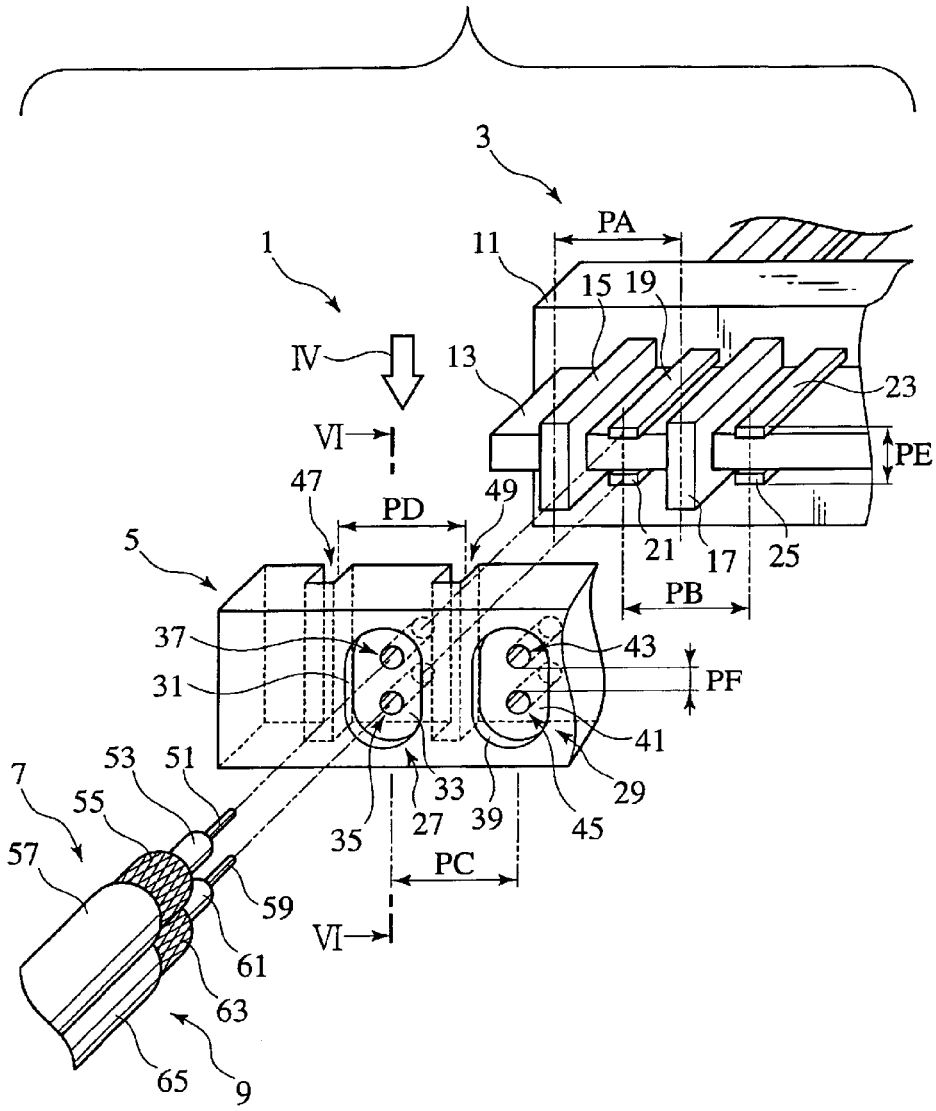
FIG. 3 is a first exploded perspective view of an exemplary embodiment of a connector according to the present invention.

FIG. 3 is an exploded view of a first embodiment of a connector according to this invention. In FIG. 3 the connector 1 includes a connector main body 3, a cable positioning member 5. A plurality of coaxial cables 7 and 9 are connected to the connector main body 3 via the cable positioning member 5.

In this example, a coaxial cable is assumed as the cable connecting to the connector main body, however technology of connecting cables such as a twin coaxial cable or like is within the scope of this invention. Further, the number and arranged positions of the coaxial cables to be connected changes in accordance with the structure of the connector main body, however the structure of the cable positioning member can easily be changed in coordination with the structure of a connector main body, that is to say, the structure of the cable positioning member is not restricted to the structure described herein below.

The connector main body 3 comprises a molded part 11 and a base 13. The base 13 is provided with a plurality of ground terminals 15 and 17 and a plurality of signal terminals 19, 21, 23 and 25. For the purpose of simplicity the explanation provided for this example includes only two ground terminals and four signal terminals.

The ground terminals 15 and 17 are arranged on the base 13 at pitch PA. The signal terminals 19 and 21, and 23 and 25 are arranged on the base 13 at pitch PB.

The cable positioning member 5 is independent of the connector main body 3 and is made of conductors, that are metal such as brass, stainless steel, copper or phosphor bronze or the like. The cable positioning member 5 comprises cable holding portions 27 and 29 that are formed so as to extend from one face of the cable positioning member 5 (in FIG. 3 the near face) toward the other face of the cable positioning member 5 (in FIG. 3 the further face) that accommodate and hold a plurality of coaxial cables 7 and 9, as well as securing portions 47 and 49 formed in the other face at which the cable positioning member 5 is secured to the ground terminals 15 and 17 of the connector main body 3. The securing portions 47 and 49 are arranged at pitch PD equivalent to the pitch PA of the ground terminals.

The cable holding portion 27 comprises outer conductor holding portions 31 and 33 that hold the outer conductors 55 and 63 of the coaxial cables 7 and 9, an insulating layer holding portion 37 that engages and holds the insulating layer 53 of the coaxial cable 7 and an insulating layer holding portion 35 that engages and holds the insulating layer 61 of the coaxial cable 9.

A plurality of such holding portions 27 are formed and in this example are arranged at equidistant pitch. That is to say, a cable holding portion 29 is formed in a position of pitch PC, the holding portion 27 providing the initial positional reference therefor. In the same way as the holding portion 27, this cable holding portion 29 comprises outer conductor holding portions 39 and 41 and insulating layer holding portions 43 and 45, and engages coaxial cables not shown in the drawings.

The engagement of the outer conductors 55 and 63 in the outer conductor holding portions 31 and 33 forms an integrated connection of the outer conductor 55 and the outer conductor 63 enabling conduction between the outer conductor 55 and the outer conductor 63. Thus, the outer conductors of a plurality of coaxial cables are all connected together as one batch. Further, considering the aspects of operability, electricity flow, strength and the like, the external forms of the outer conductor holding portion and insulating layer holding portion may be 0.05 mm larger than the external forms of respective shields (outer conductor and insulating layer) of each coaxial cable, thereby realizing the dimensions suitable for engagement. The inner side of the cable holding portions may be subject to metal plating processes.

The central conductor 51, insulating layer 53 and outer conductor 55 of the coaxial cable 7 are positioned in the predetermined position by engagement of the cable with the outer conductor holding portions 31 and 33 and the insulating layer holding portion 35. In the same manner, the central conductor 59, the insulating layer 61 and the outer conductor 63 of the coaxial cable 9 are positioned in the predetermined position by engagement of the cable with the outer conductor holding portions 31 and 33 and the insulating layer holding portion 37. The external periphery of the outer conductor 55 is covered by a sheath 57 and the external periphery of the outer conductor 63 is covered by a sheath 65.

The central conductor 51 of the coaxial cable 7 connects to the signal terminal 19 of the connector main body 3. In the same manner, the central conductor 59 of the coaxial cable 9 connects to the signal terminal 21 of the main body 3.

The insulating layer holding portions are formed at pitch PF corresponding to the pitch PE of the contacting face of the signal terminals of the connector main body to enable the central conductors of the coaxial cables to contact the signal terminals without bending, assuring that these connections are formed sufficiently.

The securing portion 47 connects to the ground terminal 15 of the connector main body 3. Further, the securing portion 49 connects to the ground terminal 17 of the connector main body 3. These connections ground the respective coaxial cables to the connector main body, enabling electrical transference therebetween.

Further, the positional relationship of the cable positioning member 5 and the connector main body 3 can be determined as appropriate, enabling the central conductors 55 and 59 of the coaxial cables 7 and 9 to be succinctly connected to the signal terminal of the connector main body 3. This results in an improved connector having superior electrical characteristics.

In FIG. 3, the securing portions 47 and 49 are formed as grooves extending from the upper face to the lower face of the cable positioning member 5, however it is also suitable for these securing portions to be formed as square shaped recesses. This enables positioning both vertically and from left to right.

Figure 4:
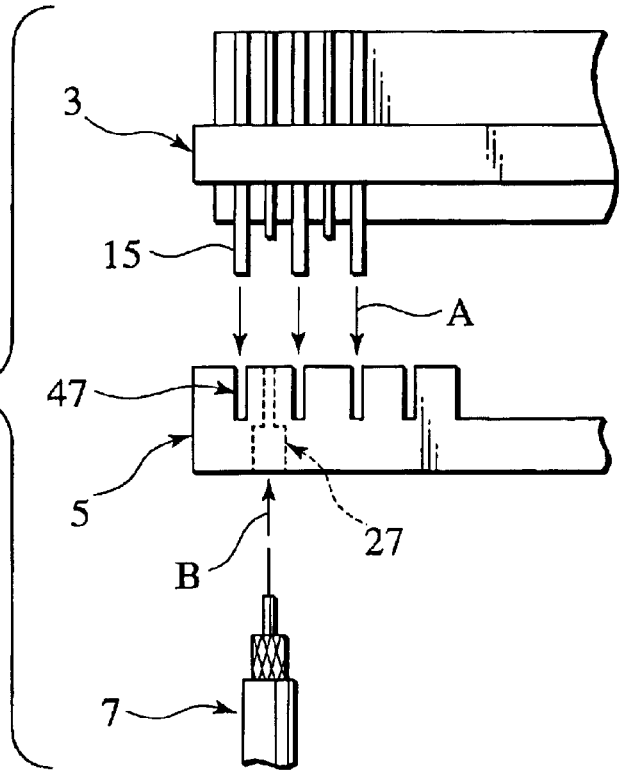
FIGS. 4 and 5 are plan views of the connector shown in FIG. 3.

FIG. 4 shows a view of the connector shown in FIG. 3 seen from the direction of the arrow IV. The ground terminal 15 of the connector main body 3 is inserted into the securing portion 47 of the cable positioning member 5 from the direction of the arrow A. Further, the coaxial cable 7 engages in the holding portion 27 from the direction of the arrow B. This realizes appropriate positioning for this coaxial cable.

Figure 5:
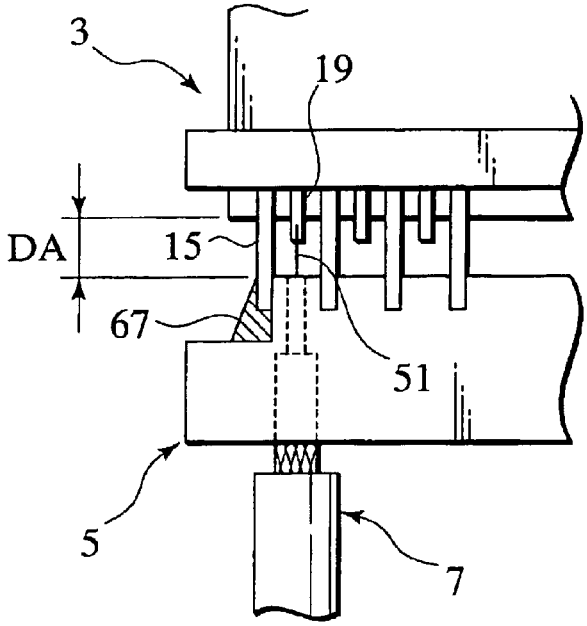

FIG. 5 shows a connector 1 for a connector assembled in accordance with the method shown in FIG. 4. As shown in FIG. 5, a gap DA is maintained between the end face of the cable positioning member 5 and the end face connector main body 3. This maintains the appropriate positional relationship between the connector main body 3 and the cable positioning member 5 and enables the central conductor 51 of the coaxial cable 7 to be properly connected to the signal terminal 19. Moreover, the ground terminal 15 is connected to the cable positioning member 5 by solder 67. This provides a sufficiently strong connector.

Figure 6:
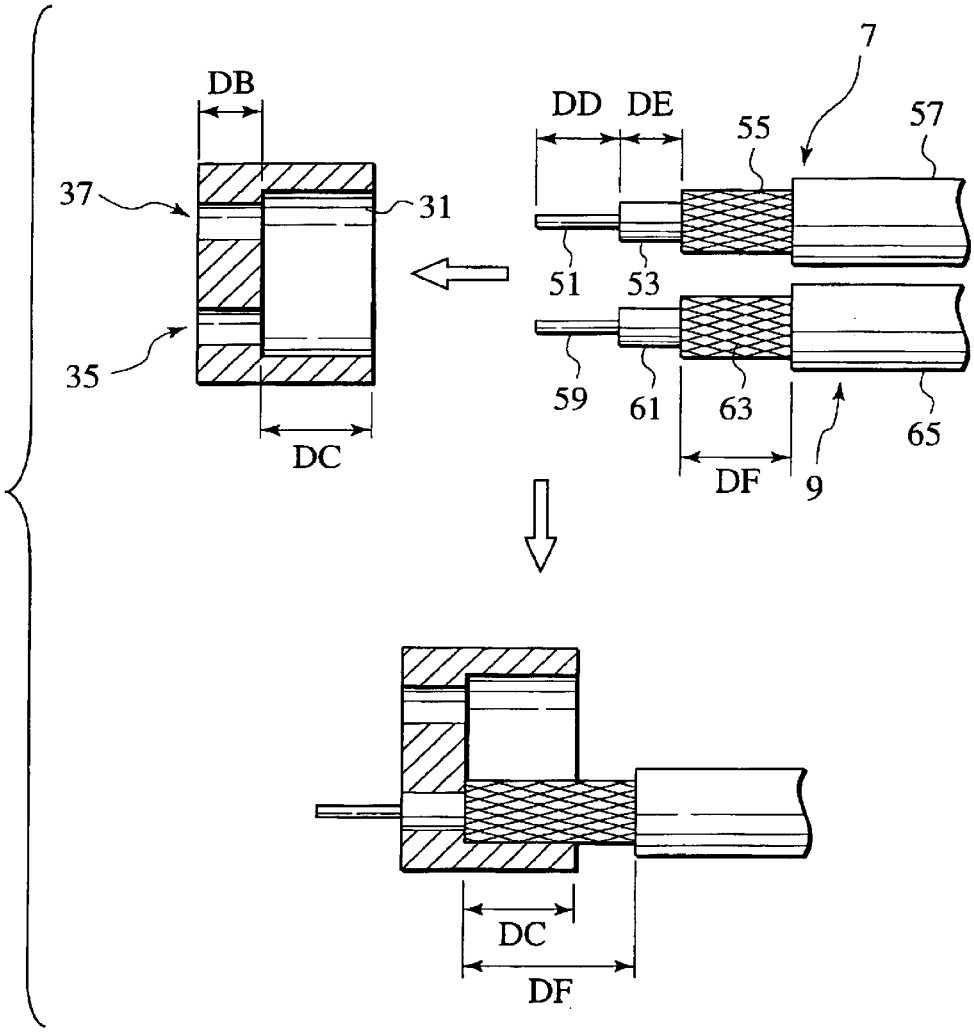
FIGS. 6 to 8 show the positioning of coaxial cables with respect to a cable positioning member of a connector.

FIG. 6 shows a cross-sectional view taken along the line VI—VI of FIG. 3. The depth DC of the outer conductor holding portion 31 is formed so as to be equal to or shorter than the length DF of the outcrop (exposed part) of the outer conductors 55 and 63. Further, the length DB of the insulating layer holding portions 35 and 37 is formed to be approximately the same length as the length DE of the outcrop of the insulating layers 53 and 61.

Figure 7:
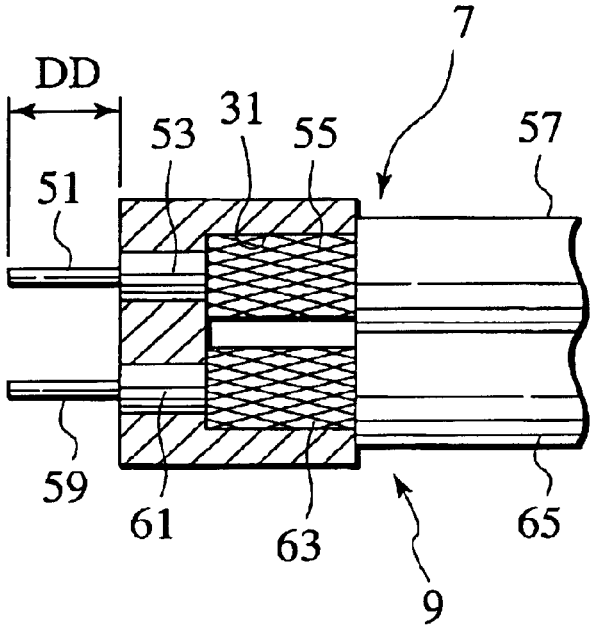

Referring to FIG. 7, the holding portion 27 being formed of the dimensions as described above, the length of the protruding central conductors 51 and 59 are of the same dimensions DD. Thus, this connector achieves improved electrical characteristics. Moreover, all of the central conductors can be definitively connected to signal terminals.

Figure 8:
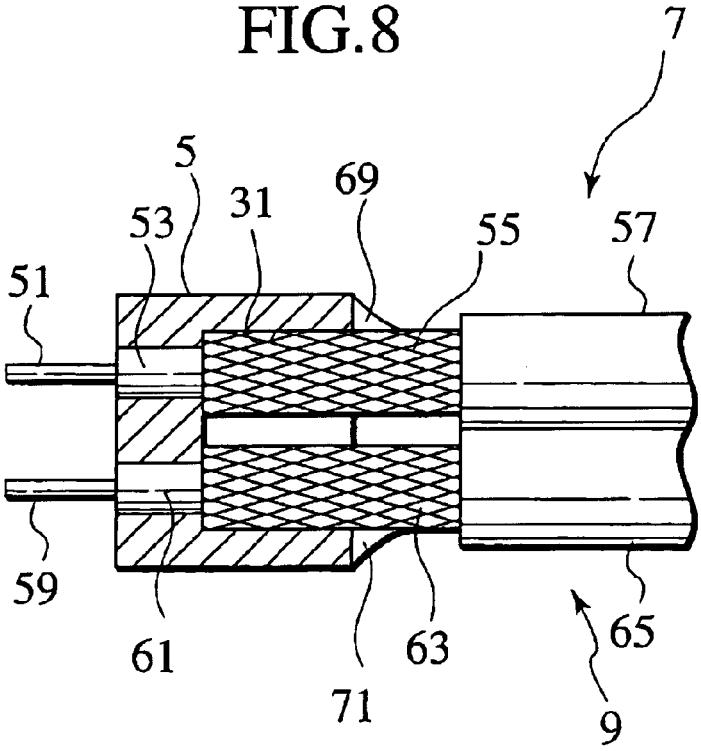

Referring to FIG. 8, the dimensions of the holding portion 27 are predetermined such that when the coaxial cables 7 and 9 are engaged in the holding portion 27 of the cable positioning member 5, the outer conductors 55 and 63 are exposed (in the same way as FIG. 6 in which the depth DC of the outer conductor holding portion 31 is shorter than the length DF of the out crop of the outer conductors 55 and 63). The exposed parts are connected to the cable positioning member 5 by solders 69 and 71. Thus, the outer conductors 55 and 63 are appropriately secured to the outer conductor holding portion 31, preventing changes arising in their mutual positional relationships.

Figure 9:
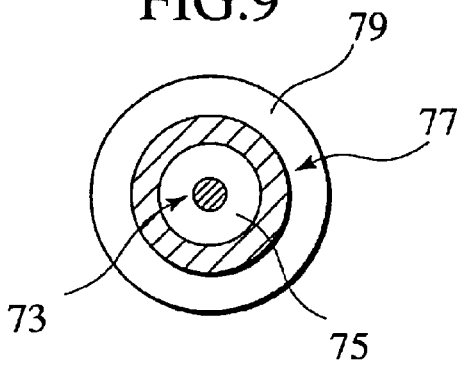
FIG. 9 is a cross-sectional view of a coaxial cable.

FIG. 9 is a cross-sectional view of a coaxial cable. The coaxial cable includes a central conductor 73, an insulating layer 75 that covers the central conductor 73, an outer conductor 77 covering the external periphery of the insulating layer 75, and a sheath 79 covering the external periphery of the outer conductor 77.

Figure 10:
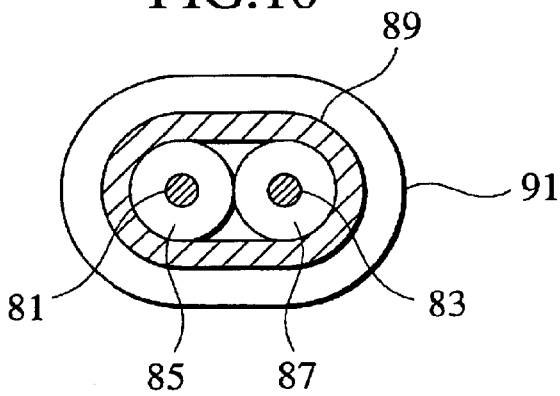
FIG. 10 is a cross-sectional view of a twin coaxial cable.

FIG. 10 is a cross-sectional view of a twin coaxial cable. The twin coaxial cable includes two central conductors 81 and 83, an insulating layer 85 covering the external periphery of the central conductor 81, an insulating layer 87 covering the external periphery of the other central conductor 83, an outer conductor 89 that covers all together the external peripheries of these insulating layers 85 and 87, and a sheath 91 covering the external periphery of the outer conductor 89.

In the above description of the connector, the coaxial cable is assumed to be as the cable connected to the connector, however the twin coaxial cable can also be used in the same way. This is to say, the insulating layers 85 and 87 engage in the insulating layer holding portions of the cable positioning member and the outer conductor 89 engages in the outer conductor holding portion.

Figure 11:
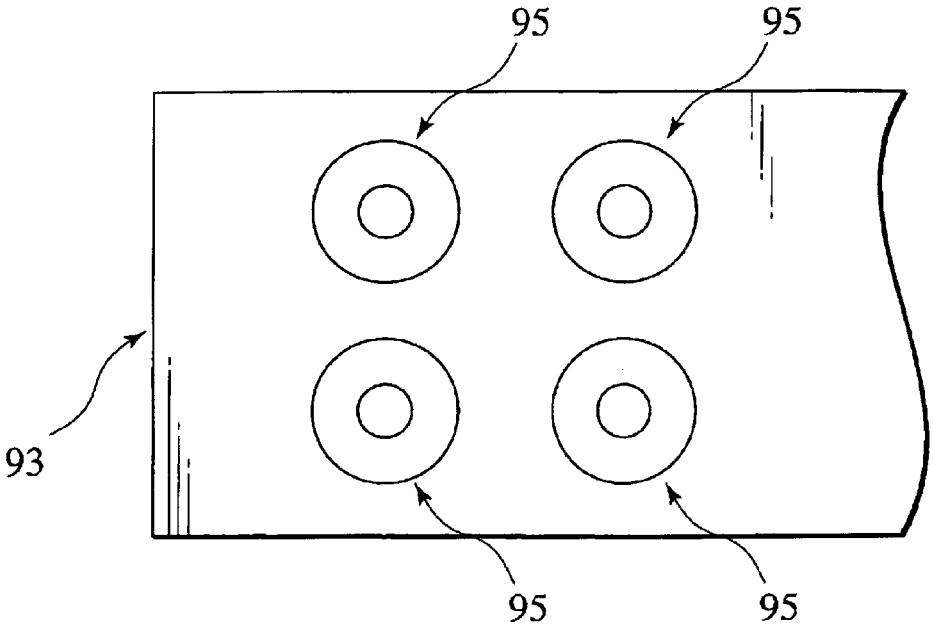
FIGS. 11 to 14 show cable positioning members of a connector having different forms of holding portions.

FIG. 11 shows another form of cable positioning member. In this cable positioning member 93, each outer conductor holding portion 95 is formed as an independent part such that one of a plurality of outer conductors can be accommodated therein. A twin coaxial cable cannot be used with this cable positioning member 93.

Figure 12:
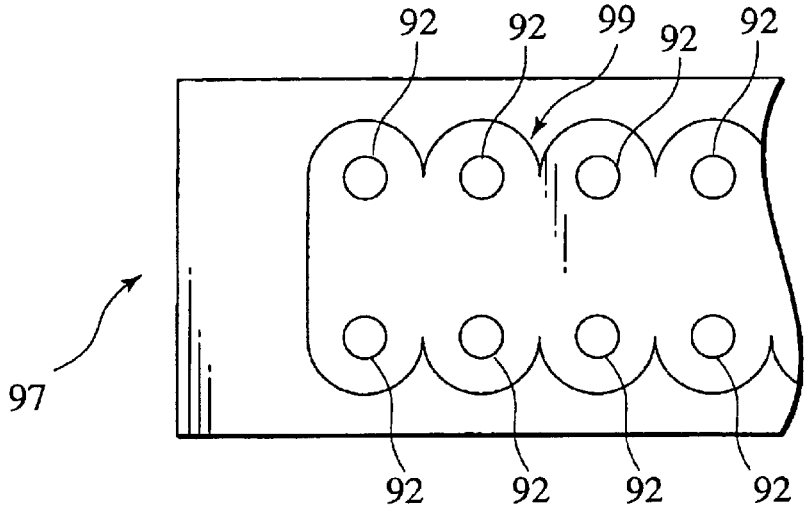

FIG. 12 shows another form of cable positioning member. In this cable positioning member 97, each insulating layer holding portion 92 is formed as an independent part, however, an outer conductor holding portion 99 is formed as an integrated part.

Figure 13:
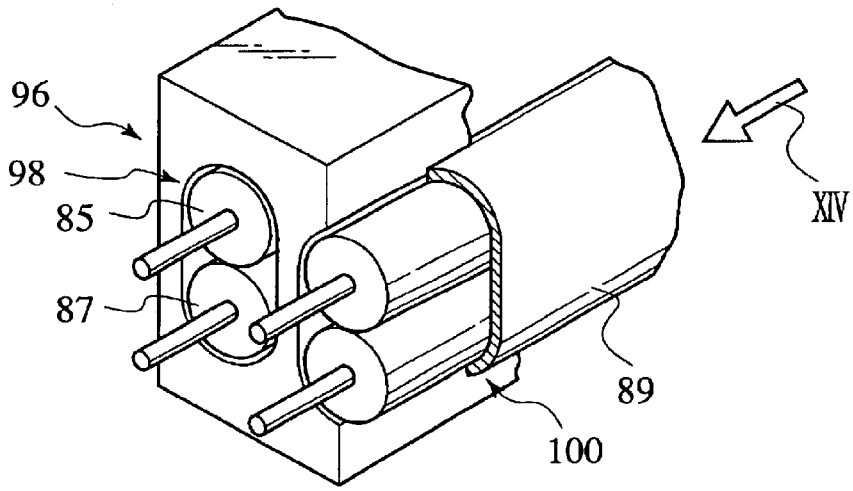

FIG. 13 shows a perspective view of a cable positioning member 96 that accommodates twin coaxial cables. As shown in FIG. 13, insulating layers 85 and 87 engage in an insulating layer holding portion 98 of the cable positioning member 96, and an outer conductor 89 engages in an outer conductor holding portion 100, thus, central conductors, insulating layers and outer conductors of the twin coaxial cables can be positioned as required and each central conductor can be properly connected to a signal terminal.

Figure 14:
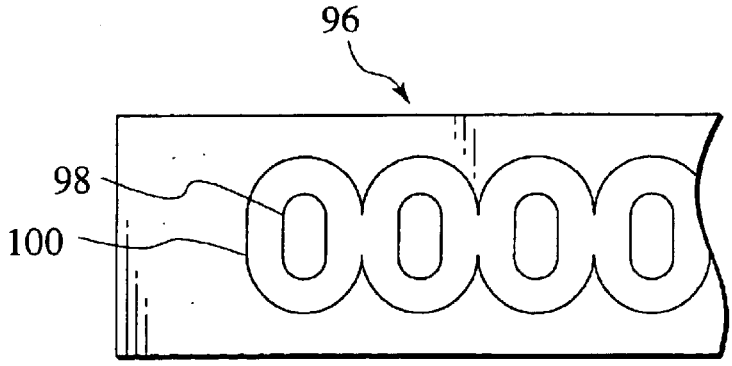

FIG. 14 shows a view from the direction of arrow XIV of the cable positioning member 96. The outer conductor holding portion 100 is formed as an integrated structure. An insulating layer holding portion 98 has an elliptical cylindrical shape allowing two insulating layers 85 and 87 to be engaged, accommodated therein.

The above described embodiments of a connector and a cable positioning member, and a assembled cable utilizing the connector have the following features.

(1) The connector (1) comprises: a connector main body including a base (13) and a plurality of signal terminals (19, 21) and a plurality of ground terminals (15, 17) both fixed to the base; and a cable positioning member (5) made of conductors for positioning a plurality of cables (7, 9) relative to the connector main body, the cable positioning member including a plurality of securing portions (47, 49) at which the cable positioning member is secured to the ground terminals, and a cable holding portion including a plurality of outer conductor holding portions (31, 33) adapted to hold an outer conductor (55, 63) protruding from the end of each cable and a plurality of insulating layer holding portions (35, 37) adapted to hold an insulating layer (53, 61) protruding from the end of each cable, wherein the cable positioning member is electrically contacted to the ground terminals at the securing portions and to the outer conductors at the outer conductor holding portions.

(2) Each of the securing portions (47, 49) includes a recess that engages each of the ground terminal (15, 17) that protrudes from the base (13) toward the cable positioning member (5).

(3) Each of the insulating layer holding portions (35, 37) is a through-hole, and each of the outer conductor holding portions (31, 33) is a recess that has one end of the through-hole on a bottom surface of the recess.

(4) The securing portions (47, 49) and the ground terminals (15, 17) are secured to each other and electrically connected by engagement and soldering.

(5) The outer conductor holding portions (31, 33) hold outer conductors (55, 63) of a plurality of cables, the plurality of outer conductors are connected as one batch enabling conduction between the outer conductors.

(6) When the outer conductor holding portions (31, 33) hold outer conductors (55, 63) of a plurality of cables, and when the insulating layer holding portions (35, 37) hold insulating layers (53, 61) of the plurality of cables, the outer conductors, insulating layers and center conductors (51, 59) of the cables are positioned in the predetermined position in relation to the connector main body (3).

(7) When the outer conductor holding portions (31, 33) hold outer conductors (55, 63) of a plurality of cables, and when the insulating layer holding portions (35, 37) hold insulating layers (53, 61) of the cables, a center conductor (51, 59) of each of the cables is connected to each of the signal terminals (19, 21) of the connector main body (3).

(8) The cable positioning member (5) is made of conductors for positioning a plurality of cables (7, 9) relative to a connector main body (3) that includes a base (13) and a plurality of signal terminals (19, 21) and a plurality of ground terminals (15, 17) both fixed to the base, the cable positioning member comprises: a plurality of securing portions (47, 49) at which the cable positioning member is adopted to be secured to the ground terminals; and a cable holding portion including a plurality of outer conductor holding portions (31, 33) adapted to hold an outer conductor (55, 63) protruding from the end of each cable and a plurality of insulating layer holding portions (35, 37) adapted to hold an insulating layer (53, 61) protruding from the end of each cable, wherein the cable positioning member is adapted to be electrically contacted to the ground terminals at the securing portions and to the outer conductors at the outer conductor holding portions.

(9) The assembled cable comprises: a plurality of cables (7, 9) each of which includes a central conductor (51, 59), an insulating layer (53, 61) covering the central conductor and an outer conductor (55, 63) covering the insulating layer; and a connector (1) attached to the plurality of cables, the connector including a connector main body (3) having a base (13) and a plurality of signal terminals (19, 21) and a plurality of ground terminals (15, 17) both fixed to the base, and a cable positioning member (5) made of conductors for positioning the plurality of cables relative to the connector main body, the cable positioning member including a plurality of securing portions (47, 49) at which the cable positioning member is secured to the ground terminals, and a cable holding portion including a plurality of outer conductor holding portions (31, 33) for holding an outer conductor (55, 63) protruding from the end of each cable and a plurality of insulating layer holding portions (35, 37) for holding an insulating layer (53, 61) protruding from the end of each cable, wherein the cable positioning member is electrically contacted to the ground terminals at the securing portions and to the outer conductors at the outer conductor holding portions.

(10) The cables (7, 9) include a coaxial cable.

(11) The cables (7, 9) include a twin coaxial cable.

As described, embodiments of a connector and a cable positioning member according to the present invention enable a plurality of outer conductors to be easily connected as one batch, moreover, the arrangement of the cable holding portions in predetermined positions in the cable positioning member enable a plurality of cables to be positioned at a uniform pitch. Further, the cable positioning member is provided with a recess or groove (securing portion) formed in a predetermined position therein, such that the central conductor of a cable can be properly connected to the signal terminal of the connector main body by precisely accommodating the ground terminal of the connector main body, engaging the ground terminal in the recess. Thus, the improved electrical characteristics of signal flow in a cable, either a coaxial cable or twin coaxial cable, can be achieved.

Moreover, the cable positioning member of a connector according to this invention being independent of the connector main body, the production process is simplified. Further, this has the effect of allowing a cable, either a coaxial cable or twin coaxial cable, to be easily connected to the connector main body.

Although the invention has been described above by reference to certain exemplary embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A connector comprising:

a connector main body comprising a base, a plurality of signal terminals and a plurality of ground terminals; and a conductive cable positioning member for positioning a plurality of cables relative to said connector main body, comprising:

a plurality of securing portions where said cable positioning member is secured to said ground terminals; and a cable holding portion comprising a plurality of outer conductor holding portions adapted to hold an outer conductor protruding from the end of each cable and a plurality of insulating layer holding portions adapted to hold an insulating layer protruding from the end of each cable, wherein said cable positioning member electrically connects said ground terminals at the securing portions to said outer conductors at the outer conductor holding portions.

2. A connector according to claim 1, wherein said cable holding portion aligns center conductors of each of the plurality of cables to electrically connect to said signal terminals.

3. A connector according to claim 1, wherein each of said securing portions comprises a recess that engages each of said ground terminals that protrude from the base toward the cable positioning member.

4. A connector according to claim 1, wherein each of said insulating layer holding portions comprises a through-hole through said cable positioning member.

5. A connector according to claim 1, wherein each of said outer conductor holding portions comprises a recess in a first surface of said cable positioning member surrounding said through hole and having one end of said through-hole on a bottom surface of said recess.

6. A connector according to claim 1, wherein each of said outer conductor holding portions is a recess in a first surface of said cable positioning member opposite said securing portions.

7. A connector according to claim 1, wherein said securing portions and said ground terminals are secured to each other and electrically connected by engagement and soldering.

8. A connector according to claim 1, wherein when said outer conductor holding portions hold outer conductors of a plurality of cables, said plurality of outer conductors are electrically connected to one another.

9. A connector according to claim 1, wherein when said outer conductor holding portions hold outer conductors of a plurality of cables, and when said insulating layer holding portions hold insulating layers of said plurality of cables, said outer conductors, insulating layers and center conductors of said cables are positioned in the predetermined position in relation to said connector main body.

10. A connector according to claim 1, wherein when said outer conductor holding portions hold outer conductors of a plurality of cables, and when said insulating layer holding portions hold insulating layers of said cables, a center conductor of each of said cables is connected to each of said signal terminals of said connector main body.

11. A connector according to claim 1, wherein said outer conductor holding portions are formed as recesses in a first surface of said cable positioning member opposite the securing portions, and a single outer conductor holding portion recess holds the outer conductors of at least two of said plurality of cables.

12. A connector according to claim 11, wherein said insulating layer holding portions are formed as through-holes extending from a bottom surface of said outer conductor holding portion recesses to a second surface of said cable positioning member adjacent to said securing portion, and each insulating layer holding portion through hole holds an insulating layer of only a single one of said plurality of cables.

13. A connector according to claim 11, wherein said insulating layer holding portions are formed as through-holes extending from a bottom surface of said outer conductor holding portion recesses to a second surface of said cable positioning member adjacent to said securing portion, and each insulating layer holding portion through hole holds insulating layers of at least two of said plurality of cables.

14. A connector according to claim 1, wherein said outer conductor holding portions are formed as recesses in a first surface of said cable positioning member opposite the securing portions, and a single outer conductor holding portion recess holds an outer conductor of only a single one of said plurality of cables.

15. A connector according to claim 14, wherein said insulating layer holding portions are formed as through-holes extending from a bottom surface of said outer conductor holding portion recesses to a second surface of said cable positioning member adjacent to said securing portion, and each insulating layer holding portion through hole holds an insulating layer of only a single one of said plurality of cables.

16. A conductive cable positioning member for positioning a plurality of cables relative to a connector main body that comprises a base, a plurality of signal terminals and a plurality of ground terminals, said cable positioning member comprising:

a plurality of securing portions at which said cable positioning member is adapted to be secured to said ground terminals; and a cable holding portion comprising a plurality of outer conductor holding portions adapted to hold an outer conductor protruding from the end of each cable and a plurality of insulating layer holding portions adapted to hold an insulating layer protruding from the end of each cable, wherein said cable positioning member is adapted to electrically connect said ground terminals at the securing portions to said outer conductors at the outer conductor holding portions.

17. An assembled cable comprising:

a plurality of cables each comprising a central conductor, an insulating layer covering said central conductor and an outer conductor covering said insulating layer; and a connector attached to said plurality of cables, said connector comprising:

a connector main body comprising a base, a plurality of signal terminals and a plurality of ground terminals; and a conductive cable positioning member for positioning said plurality of cables relative to said connector main body, comprising:

a plurality of securing portions at which said cable positioning member is secured to said ground terminals; and a cable holding portion comprising a plurality of outer conductor holding portions for holding an outer conductor protruding from the end of each cable and a-plurality of insulating layer holding portions for holding an insulating layer protruding from the end of each cable, wherein said cable positioning member electrically connects said ground terminals at the securing portions to said outer conductors at the outer conductor holding portions.

18. An assembled cable according to claim 9, wherein said cables include a coaxial cable.

19. An assembled cable according to claim 9, wherein said cables include a twin coaxial cable.

* * * * *